United States Patent [19]

Ishikawa

[11] 4,163,351

[45] Aug. 7, 1979

[54] ARCHITECTURAL PANEL MATERIAL FOR USE AS ROOFING MATERIAL, MATERIAL FOR EXTERNAL WALL AND THE LIKE PURPOSES

[76] Inventor: Takashi Ishikawa, No. 1355,, Ooaza Higashine Ko, Higashine-shi, Yamagata-ken, Japan

[21] Appl. No.: 854,952

[22] Filed: Nov. 25, 1977

[30] Foreign Application Priority Data

Nov. 30, 1976 [JP] Japan ..... 51-161061[U]

[51] Int. Cl.[2] ..... E04D 1/18

[52] U.S. Cl. ..... 52/542; 52/556

[58] Field of Search ..... 52/518, 519, 520, 528, 52/533, 534, 535, 542–556, 746

[56] References Cited

U.S. PATENT DOCUMENTS

| | | | |
|---|---|---|---|
| 1,911,141 | 5/1933 | Fischer | 52/542 |
| 2,450,562 | 10/1948 | Robinson et al. | 52/556 |
| 2,685,852 | 8/1954 | Godel | 52/556 X |
| 2,811,118 | 10/1957 | Ball | 52/518 X |
| 3,121,649 | 2/1964 | Oliver | 52/746 |
| 3,848,383 | 11/1974 | Wilson et al. | 52/542 X |
| 3,875,715 | 4/1975 | Martin et al. | 52/556 |

*Primary Examiner*—J. Karl Bell

*Attorney, Agent, or Firm*—Blanchard, Flynn, Thiel, Boutell & Tanis

[57] ABSTRACT

The efficiency of work for constructing the roof, the external walls and the like of a house will be greatly improved if the architectural material is standardized and designed to minimize the processing which must be made at the site. To this end, there is provided a specific profile of an architectural panel material, i.e. a substantially inverted T-shaped profile mainly consisting of a main body section having an inclined area, and an overlapping head section having an overlapping area continuous with and projecting toward the upper side from the inclined area. Remarkable effects, in addition to above stated advantages, are derived from this profile, such as preventing infiltration of rainwater into the back side of the panel, improved mechanical strength, and an attractive three-dimensional appearance of the finished roof and external wall.

8 Claims, 12 Drawing Figures

ARCHITECTURAL PANEL MATERIAL FOR USE AS ROOFING MATERIAL, MATERIAL FOR EXTERNAL WALL AND THE LIKE PURPOSES

BACKGROUND OF THE INVENTION

Conventionally, in forming the roof and external walls of a building with metallic panels, the panels are joined to one another through seams or other male-and-female fitting structures formed on the panels, so as to form the roof and the external wall. Also, for constructing the roof and the external walls of plastic material, it is a common measure to superimpose the end portions of adjacent corrugated plastic plates and fix them to each other by means of nails or the like.

However, the roofs and external walls constructed by the above stated methods have various drawbacks or shortcomings as set forth below.

Namely, concerning the roofing material, in the case of a flat roof, troublesome work of material preparation and bending of a major part of the seam at the factory, as well as sheet metal work, i.e., hitting and flattening of the seams, after the engagement of the seams at the site, are indispensable, which inconveniently reduces the working efficiency. In addition, the packing and transportation of the plate materials are rendered toublesome and difficult due to the presence of seams on these plates. Furthermore, the roof having the described structure often suffers from corrosion of sheathing board and so on, due to invasion by rain water caused by capillary action. In addition, this type of structure requires accessories or additional parts such as clips, which inconveniently reduce the working efficiency and increase the cost of the building. At the same time, the roof constructed with architectural material of this kind can have only a flat face of poor designability and three-dimensional appearance.

In the case of external walls constructed with this kind of material, the work is rendered quite inefficient, partly because the plane to be worked is always vertical and partly because the materials are used for different areas of the wall. The resulting wall has also a poor three-dimensional appearance.

SUMMARY OF THE INVENTION

It is therefore an object of the invention to overcome the above described problems inherent in the prior art, by providing an architectural material which has a connecting structure of the mounting or overlapping type, rather than the seam or other male-and-female connecting structure which may allow the undesirable capillary action, and which allows a free selection of the width of the joint and, in addition, can be completely fabricated in the factory and, further, can produce a tapered space or gap of a height gradually increasing as it gets from the top to the bottom portion of the material, so as to present a good three-dimensional appearance, as well as improved working efficiency and a reduced cost.

It is another object of the invention to provide, for the same purpose as that of the first object, an architectural panel material having a substantially inverted T-shaped profile consisting of a main body section having an inclined surface and an overlapping head section projected upwardly from the main body section and having a overlapping area.

It is still another object of the invention to provide an architectural panel material in which tabs are turned up or down from the main body and the overlapping head sections, so as to prevent rain water from infiltrating into the material and so as to withstand the external force (e.g. weight of snow or man on the roof, wind force applied against the wall and so forth), and which can present an attractive appearance of the whole structure, from a view point of architectural design, when a plurality of the materials are secured successively to the object such as the base of a roof or wall.

These and other objects, as well as the advantageous features of the invention will become clear from the following description of the preferred embodiments taken in conjunction with the attached drawings in which:

DESCRIPTION OF THE PREFERRED EMBODIMENTS

Figure 1:
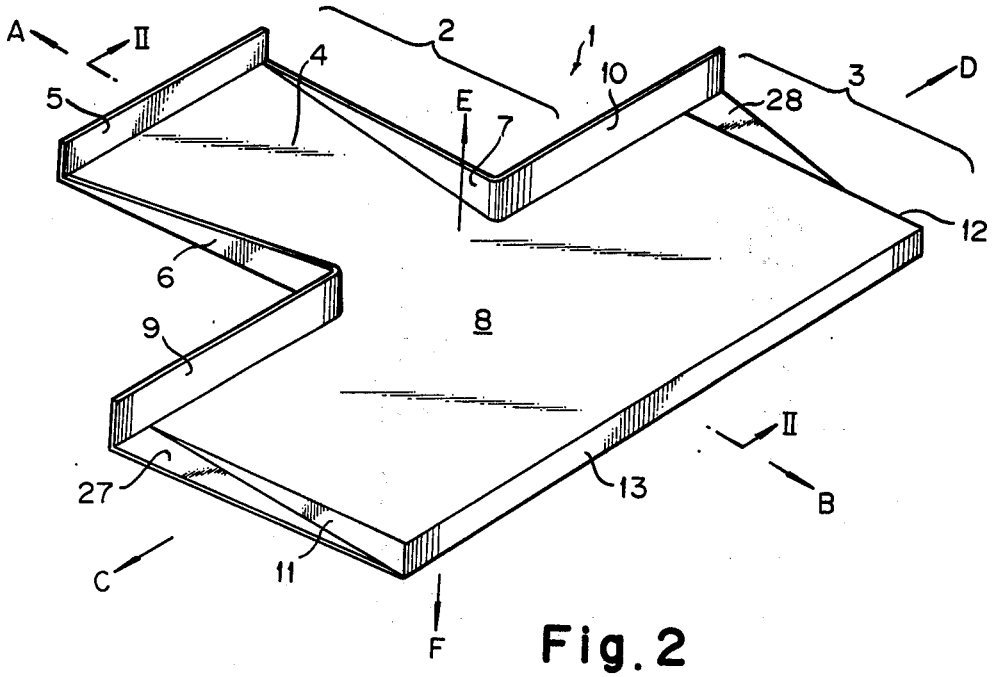
FIG. 1 is a perspective view of an architectural panel material of the invention, showing the basic form and structure of the same.

Hereinafter, the invention will be described in detail with reference to the attached drawings. In the following description, as well as in the foregoing description, the words "upper side" and "lower side" are used to designate at the directions given by arrows A and B in FIG. 1, respectively. Similarly, the terms "left" and "right" are used to mean the directions given by arrows C and D. Also, the words "upward" or "top side" and "downward" or "under side" shall be understood to designate at the directions given by arrows E and F, respectively. Throughout the drawings, same and corresponding parts are denoted by the same reference numerals.

Referring first to FIG. 1 showing a basic form of an architectural panel material of the invention, the architectural panel material generally denoted by numeral 1 is made of a thin plate of a metal or a plastic. For instance, surface-treated steel plates such as zinc-coated plate, color plate, vinyl chloride plate and so forth, aluminum plate, copper plate, stainless steel plate and so on are chiefly used as the metallic plate material. Also, the plastic plate material is mainly a plate of vinyl chloride.

The architectural plate material 1 has generally an inverted T-shaped or the like profile. The profile of this module has been selected so an image of conventional "elongated material" and for imparting a continuous appearance even to a small area of the house exterior, as well as for convenience' sake in handling and transporting by only one person.

The panel material 1 is formed from a blank as stated above, as an integral body, by means of bending and/or press-forming, and has an overlapping head section 2 and a main body section 3 as its major parts. The overlapping head section 2 consists of an overlapping surface portion or area 4 of a rectangular or the like shape, an upwardly turned tab 5 formed at the upper side end of the overlapping area 4 and upwardly turned tabs 6, 7 formed at right and left side edges of the same. The upward tabs 6 and 7 are preferably inclined so that their height increases toward the lower side of the overlapping area 4. Needless to say, these tabs may be turned by a small height. These tabs 5, 6, 7 are intended for preventing the rain water from flowing to the undesired region, and for an additional function of reinforcement to make the panel material able to withstand external pressure.

As will be detailed later, the overlapping head section 2 plays a double function of underlayer at the joint between adjacent panel materials and an anchoring portion for fixing the panel material, as well as a function of imparting a resiliency to the main body section 3.

The main body section 3 has an inclined area 8 of a substantially rectangular shape, upwardly turned tabs 9, 10 formed at the upper side end, and tabs 11, 12, 13 turned downwardly from the left, right and the lower side ends of the inclined area 8.

The inclined area 8 functions as the so-called effective working width of the panel. The downward tabs 11, 12 are unitary walls intended for forming a tapered space 14 for presenting a three dimensional appearance to the panel material, under the same. The downward tabs 11, 12 start from the upper side end of the main body section 3, i.e. from the lower side end of the overlapping head section 2.

The upward tabs 9, 10 are formed at the upper side end of the main body section 3, unitarily with and continuously from the upward tabs 6, 7, and are intended for preventing the rainwater from leaking and for a guide or stopper for adjacent panel materials. The downward tab 13 functions as a cover for closing the bottom of the tapered space 14, and as a reinforcement for withstanding external force.

In the illustrated embodiment, the upward tabs 5, 9, 10 and the downward tab 13 are bent by almost 90°, as well as the upward tabs 6, 7 and the downward tabs 11, 12. However, this angle is not exclusive, and these tabs may be bent by other angle.

Figure 2:
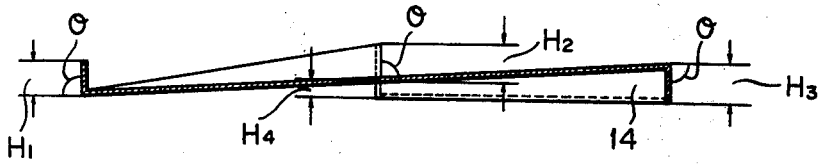
FIG. 2 is a sectional view taken along the line II—II of FIG. 1.

As to the lengths and heights, the heights $H_1$, $H_2$ and $H_3$ are preferably equal or as given by: $H_3=H_2$, $H_1<H_3$. The height $H_4$ is preserved for keeping the space 14 in the closed state, and is determined as being zero or 5 mm (See FIG. 2), depending on the relationship between lengths $L_1$ and $L_2$.

Figure 3:
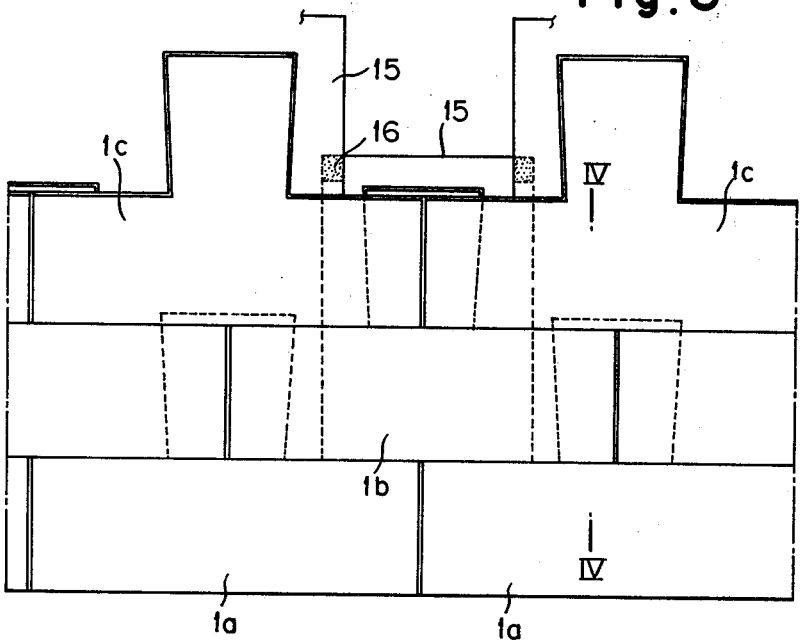
FIG. 3 is a plan view of a plurality of the panel materials of FIG. 1 installed on a roof base.
Figure 4:
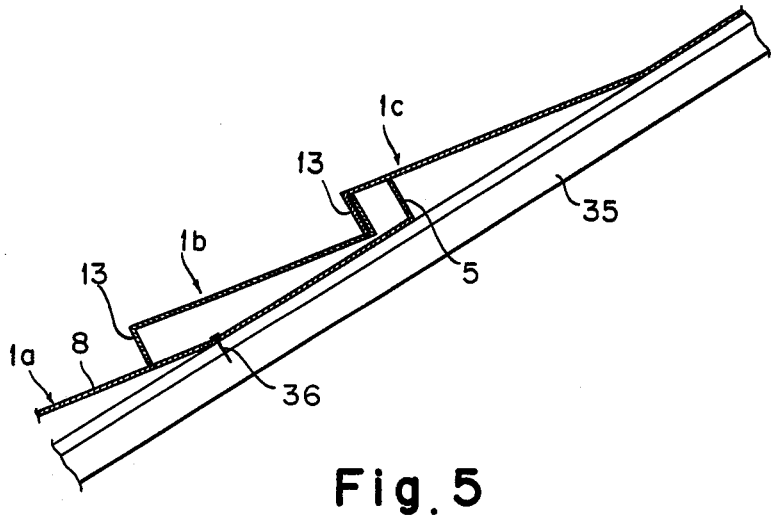
FIG. 4 is a sectional view taken along the line IV—IV of FIG. 3.

If the length $L_1$ is smaller than the length $L_2$, the panel materials are situated in the manner as shown in FIGS. 3 and 4, and the height $H_4$ projects into the underspace 14 to a certain depth, so as to act as a reinforcement. When the lengths $L_1$ and $L_2$ are equal to each other, the upward tabs 9, 10 comes to the contacted by the upward tab 5 of the adjacent panel material. Although this affords a sufficient strength and rainwater-prevention at the contacting area, the reinforcement of the under space 14 seems insufficient. The lengths $L_2$ and $L_3$ largely affect the effective working width of the panel material, while the length $L_4$ can optionally be selected as long as it permits the overlapping head section 2 to function as the underlayer and support for the main body section 3 of the adjacent panel material.

The length $L_5$ is closely related to the height $H_2$ of the upward tabs 6, 7. More preferably, the relationship as given by $L_4 - L_5 = 2H_2$ (See FIG. 5) is preferred but the relationship of $L_4 = L_5$ is acceptable.

A backing material 15 has at least one of the functions of waterproofing, heat-insulation and moisture absorption.

The backing material 15 is made of a plastic sheet, asphalt felt, thin metal plate, synthetic rubber sheet, waterproof canvas, kraft paper or asbestos paper treated for waterproofing, and so on, or a laminated sheet material of at least two of these materials.

Figure 5:
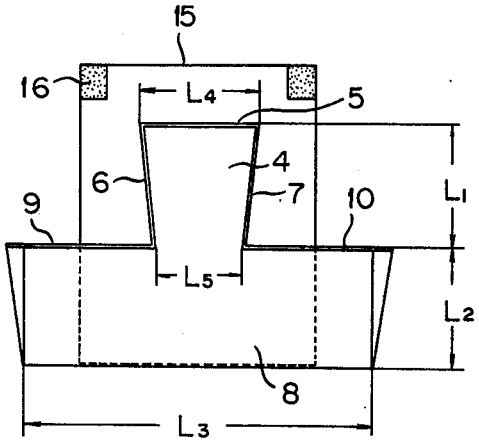
FIG. 5 is a plan view of a structural panel material combined with a sheet-like underlayer.

The size of the backing material 15 in relation with the panel material 1 is determined, for example, as shown in FIG. 5. The backing material 15 is unitarily fixed at its one end to the underside of the main body 3 and at a portion near the other end to the underside of the overlapping head section 2.

As will be seen from FIG. 5, the backing material 15 unitarily secured to the main body section 3 and to the overlapping head section 2 may have at its marginal edge, especially at portions thereof which are to be put into contact with the adjacent panel material, a layer 16 of adhesive covered with a paper strip capable of being peeled off, so as to improve the watertightness between the neighbouring backing material 15 (See FIG. 3).

Figure 6:
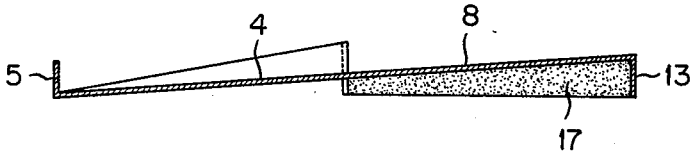
FIG. 6 is a sectional view substantially corresponding to that of FIG. 2 and showing the material along with a filler with which the space formed under the material is filled.

The space formed under the inclined area 8 of the main body section 3 may be filled with core material 17 or filler, as shown in FIG. 6.

For instance, the core material 17 may be polyisocyanurate foam, polyisocyanulete foam, vinyl chloride foam, glass wool, rock wool, plaster board, foamed plaster and so forth. These materials may be shaped as a solid core material 17 and fit into the space 14 or, alternatively, these materials in liquid state may be flowed into the space 14 to fill the latter.

It will be seen that the heat and noise insulating characteristics, as well as noise absorbing characteristic are largely improved by the presence of this core material.

Needless to say, the refractory and heat-resistant properties of the structure can be improved by adding an additive to the core material 17. (See FIG. 6). The materials suitable for use as additives are: refractory powders, borax, sodium carbonate, aluminum hydroxide, pearlitic grain, vermiculite, talc, zeolite, cement, calcium carbonate, calcium silicate, fibrous material and so on.

Figure 7:
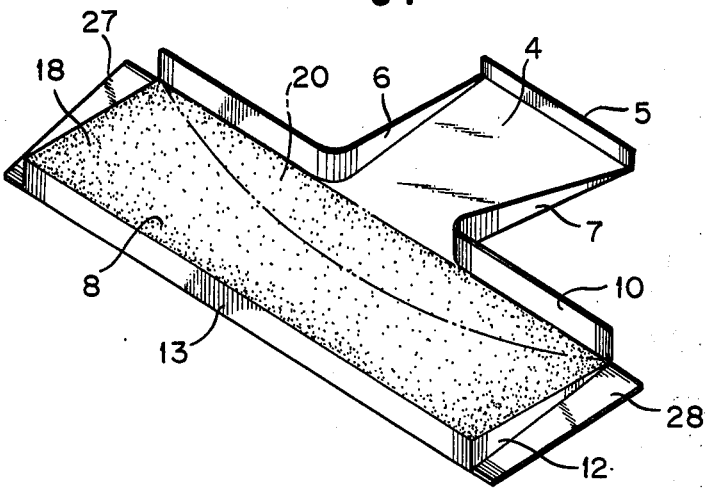
FIG. 7 is a perspective view of an architectural panel material having a coating layer formed on the top side of the inclined surface.
Figure 8:
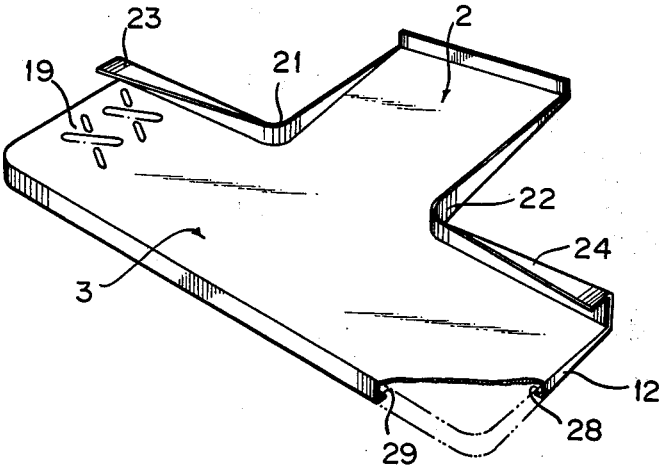
FIG. 8 is a perspective view of another embodiment of the architectural panel material of the invention, in which an upwardly turned tab at the upper end of the main body section is provided with a flange, while downwardly turned tabs at both side edges and lower edge of the main body section are provided with inwardly extending flanges.

At the same time, the top side of the inclined area 8 may be wholly or partially coated with a coating layer 18, as shown in FIG. 7. In addition to or in place of the coating layer 18, the inclined area 8 may be provided at its top surface with roughness 19, as shown in FIG. 8.

For instance, for forming a mortar lithin coat as the coating layer 18 on the top side of the inclined area 8, at first a base coat is formed, and then grains such as quartz sand, glass powder, stone powder, ceramic powder and the like, of a grain size of 0.5 to 1.7 mm are spread over the base coat, at a density of 100 to 20 grains per square centimeter, and finally an overcoat is applied. Alternatively, the base coat and the powders may be applied simultaneously, on which the overcoat is provided. Needless to say, the coating layer may be formed by the known technique of 2 coats and 3 bakes.

The above stated density of the dispersion of grains ensures that the grains are isolated from one another and, therefore, are effective to impart a clear feel of convexity and concavity to bring the appearance of the panel into relief.

Also, no pin-hole is caused in the fixation of the grains, and the base coat and over coat in combination perform a good anchoring function to prevent the grains from dropping off from the coating layer.

At the same time, an attractive pattern can be formed by partially enriching the coating layer in the grain. The three-dimensional appearance of the roofing material will be further emphasized by forming the coating layer only at the lower side portion of the inclined area 8, with the region 20 (FIG. 7) of the latter being left uncovered.

Furthermore, when the panel material provided with the mortar lithin coat is used as the roofing material, a remarkable effect is derived that the snow lying on the roof is prevented from slipping. Also, the worker on the roof is protected against falling down by slipping. This effect is remarkable especially in snowy countries in preventing snowside snowslides from the roof.

The roughness 19 is effective to prevent the slip, as well as to impart an attractive appearance, from a view point of design, to the top side of the inclined area 8.

The upward tabs 9, 10 of the main body section 3 can be formed, wholly or partially, unitarily with the upward tabs 6, 7 of the overlapping head section 2, respectively. More specifically, as shown in FIG. 8, these tabs may be in the form of a pair of right and left side tabs 2 which are in symmetry with each other, for serving as a rainwater deflectors and for engaging pieces. The tabs 21, 22 are bent at their ends toward the lower side to form horizontally extending retaining tabs 23, 24. The retaining tabs 23, 24 have, as shown in FIG. 8, a width which gradually increases as it gets closer to the both lateral sides. These retaining tabs are adapted to engage flanges of the adjacent panel material placed thereon (as will be detail later, these flanges are formed by inwardly bending the downward tab 13), so as to permit the panel material to stand up against a strong wind force applied from the lower side.

All or some of the upward tabs 9, 10 and downward tabs 11, 12, 13 of the main body section 3, and upward tabs 5, 6, 7 of the overlapping head section 2 are provided with flanges extending horizontally therefrom.

Figure 9:
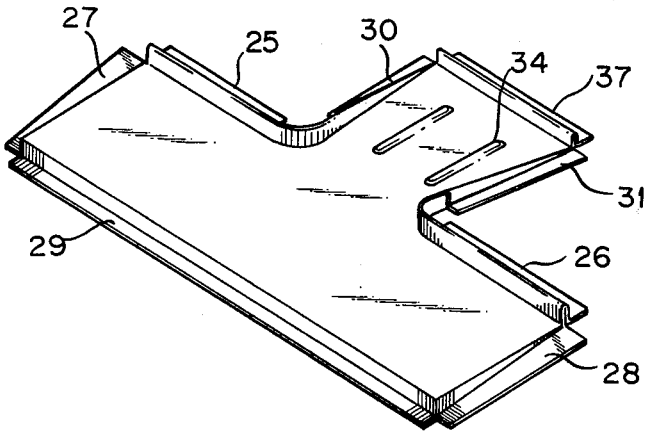
FIG. 9 is a perspective view of another embodiment of the architectural panel material of the invention, in which a flange is provided at the peripheral section of the overlapping head portion and an unevenness is formed on the overlapping head section.
Figure 10:
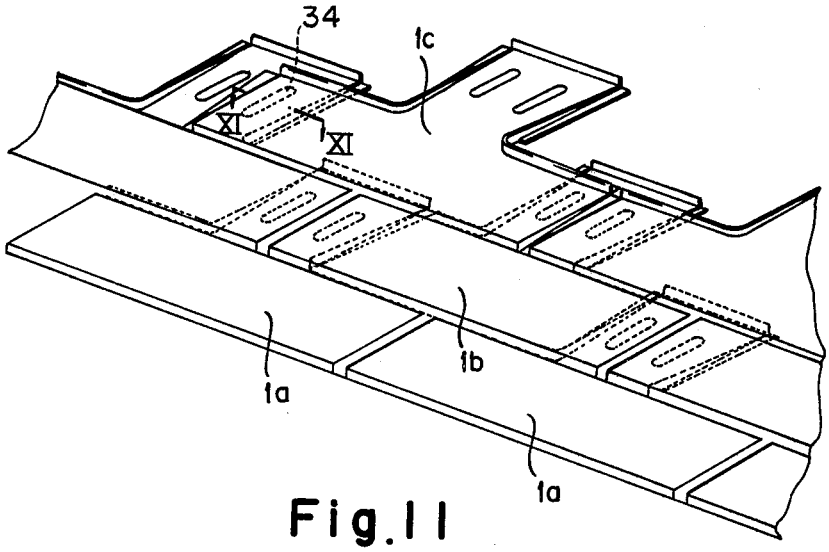
FIG. 10 is a perspective view of the plurality of panel materials of FIG. 9 in the assembled state.
Figure 12:
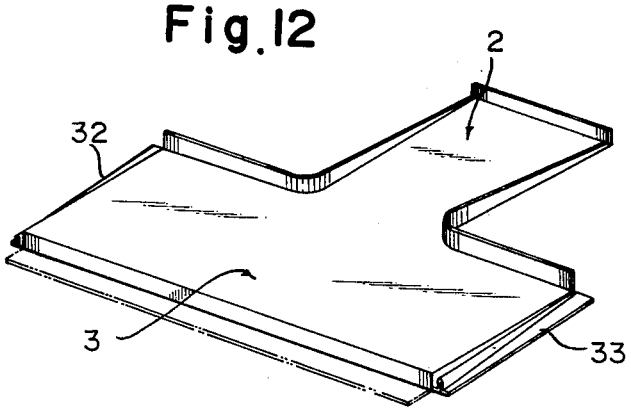
FIG. 12 is a perspective view of still another embodiment of the invention, in which a flange equipped with a rib or protrusion is provided on each of the downwardly turned tabs at both side edges of the main body section.

In the embodiment as shown in FIG. 9, there are provided eight flanges, 25 to 31 and 37. These flanges 25–31, 37 are intended for stabilizing the panel materials when they are placed on the roof base and the like parts, as will be seen from FIG. 10. The flanges 27, 28, 29 on the tabs 11, 12, 13 may be bent inwardly as are in FIG. 8 to extend from respective tabs into the space 14 under the inclined area 8. Further, the flanges 27 and 28 may be provided with ribs 32, 33, as shown in FIG. 12.

Figure 11:
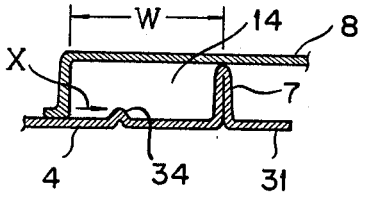
FIG. 11 is a sectional view taken along the line XI—XI of FIG. 10.

In the embodiment as shown in FIGS. 9 and 11, the upward tabs 6, 7 and 5 are formed as ribs which protrude from the overlapping head section 2, and the portions of the latter outside of these rib-like tabs are utilized as the flanges 30, 31 and 37, respectively.

The surface of the overlapping area 4 of the overlapping head section 2 may be wholly or partially provided with protrusion of various shapes, an example of which is shown in FIG. 9. Namely, protrusions denoted by 34 are formed on the overlapping area 4 at a portion of the latter where the joint portion of the adjacent panel material is positioned, and extends upwardly by a height of 3 to 10 mm. This protrusion is formed on the overlapping area 4 for performing a double function of prevention of rainwater from coming into the panel and of a reinforcement for increasing the resiliency of the supporting end when the main body section 3 imparts a resiliency in the direction perpendicular to the inclination. More specifically, as to the prevention of invasion by rainwater, the rain water coming into from the direction of arrow X of FIG. 11 is interrupted and returned to the lower side by the protrusion 34 on the overlapping area 4. Also, the invasion of rainwater due to a capillary action which would take place at the bent boundary portion of the panel materials 1 is fairly avoided, by the inclination of the roof or the external wall. Two protrusions 34 may be formed as shown in FIG. 11. Also, the protrusion 34 can have any desired shape.

Although not shown, the upward tab 5 of the overlapping head section 2 may be provided with a flange which extends toward the lower side end.

Hereinafter, an explanation will be made as to the installation of the panel materials of the invention, by way of example, as roofing materials.

Referring to FIG. 4 which is a sectional view taken along the line IV—IV of FIG. 3 showing the panel materials in the installed state, at first a panel material **1*a* is placed on a backing plate 35 and fixed to the later by means of nails 36 driven to any desired portion of the overlapping area 4 or flanges 25, 26, 30, 31. Then, another panel material 1*b* is placed on the pan 1 material 1*a*, as shown in FIG. 3, in such a manner that the back side of the inclined area 8 of the panel material 1*b* is put in contact with at least a portion of the upward tabs 6, 7 of the panel material 1*a*, and fixed to the backing plate by means of nails in the same manner as the panel material 1*a*. The next panel 1*c*** and further panel materials are placed and fixed successively, in the same manner, thereby to complete a roof.

As will be seen from FIG. 4, the boundary region between the main body section 3 and the overlapping head section 2 is bent or curved slightly. This is attributable to a resiliency imparted to the inclined area of the material, peculiar to the mechanical property and structural feature of the material.

At the same time, the inclined area is made to closely contact the vertical area of the underlying panel material. The overlapping head section 2 is provided for performing a function of a backing material for the joint portion of another panel material placed on the panel material to which the head section 2 belongs, as well as a function of preventing the rainwater from coming into space under the panel. Also, it will be seen that the upward tab 5 functions as a reinforcer for maintaining the inclined space 14.

The adjacent panels are assembled with each other, as will be seen from the enlarged view of FIG. 11, with an overlapping length which is large enough to prevent the rainwater from coming into the back side of the panel material by a capillary action.

What is claimed is:

1. An architectural panel useful as a roofing material or an external wall material, comprising: a thin plate having the shape of an inverted T in plan view in which the lower crossbar portion of the T defines a main body section having an inclined area and the upper stem portion of the T defines a head section which is adapted to be overlapped by the main body sections of other like plates, said head section having an upper edge and side edges extending downwardly from the ends of said upper edge, said main body section having a lower edge, side edges extending upwardly from the ends of said lower edge and upper edge portions extending from the upper ends of said side edges of said main body section to the lower ends of the side edges of said head section, upwardly projecting tabs extending along the upper edge portions of said main body section and projecting upwardly from the plane of said main body section, downwardly projecting tabs extending along the side edges and the lower edge of said main body section and projecting downwardly from the plane of said main body section, said downwardly projecting side edge tabs of said main body section progressively increasing in height in a direction from said upper edge portions of said main body section to said lower edge thereof, said downwardly projecting side edge tabs and lower edge tab defining the side and lower edges of a tapered space under the inclined area of said main body section which space decreases in height from said lower edge to said upper edge portions; an upwardly projecting tab extending along the upper edge of said head section and projecting upwardly from the plane of said head section, upwardly projecting tabs extending along the side edges of said head section and projecting upwardly from the plane of said head section, said upwardly projecting side edge tabs of said head section progressively increasing in height in a direction from said upper edge of said head section to the upper edge portions of said main body section, wherein the height ($H_3$) of said downwardly projecting tab along the lower edge of said main body section (1) is substantially equal to the height ($H_2$) of said upwardly projecting tabs along the upper edge portions of said main body portion, and (2) is substantially equal to or greater than the height ($H_1$) of the upwardly projecting tab along the upper edge of said head section, and wherein the length of said head section is greater than the length of said main body section.

2. An architectural panel as claimed in claim 1, wherein said inclined area of said main body section is wholly or partially provided, on its top side, with at least one of a coating layer and roughened area.

3. An architectural panel as claimed in claim 1, wherein said upwardly projecting tabs along the upper edge portions of said main body section are unitary with and extend continuously from the lower ends of said upwardly projecting tabs along the side edges of said head section.

4. An architectural panel as claimed in claim 1, wherein said upwardly projecting tabs along the upper edge portions of said main body section have along their outer edges retaining tabs which are bent and extend toward the lower edge of said main body section.

5. An architectural panel as claimed in claim 1, wherein at least one of said upwardly projecting and downwardly projecting tabs formed along the upper edge portions, side edges and lower edge of said main body section, and said upwardly projecting tabs along the upper edge and the side edges of said head section is provided with a flange extending horizontally therefrom.

6. An architectural panel as claimed in claim 1, wherein said downwardly extending tabs along the side edges of said main body section are provided with respective flanges extending horizontally therefrom, said flanges being provided with upwardly projecting ribs.

7. An architectural panel as claimed in claim 1, wherein said downwardly extending tabs along the side edges and lower edge of said main body section are provided with respective flanges extending horizontally therefrom, said flanges being directed toward said tapered space formed under said inclined area.

8. An architectural panel as claimed in claim 1, wherein said upper surface of said head section has protrusions extending therefrom.

* * * * *